United States Patent [19]

George

[11] 4,079,283

[45] Mar. 14, 1978

[54] HIGH WATTAGE INCANDESCENT LAMP WITH SUPPORT FOR A PLANAR SEGMENTED FILAMENT

[75] Inventor: Frederick J. George, Hamilton, Mass.

[73] Assignee: GTE Sylvania Incorporated, Danvers, Mass.

[21] Appl. No.: 786,164

[22] Filed: Apr. 11, 1977

[51] Int. Cl.[2] ..... H01K 1/18; H01K 1/26

[52] U.S. Cl. ..... 313/113; 313/273; 313/315

[58] Field of Search ..... 313/113, 222, 273, 315

[56] References Cited

U.S. PATENT DOCUMENTS

| | | | |
|---|---|---|---|
| 2,042,540 | 6/1936 | Manders | 313/273 X |
| 3,441,774 | 4/1969 | Stone et al. | 313/273 X |
| 3,445,713 | 5/1969 | Cardwell, Jr. | 313/222 X |
| 3,522,470 | 8/1970 | Bonazoli et al. | 313/222 X |
| 3,544,830 | 12/1970 | George et al. | 313/222 X |
| 3,555,338 | 1/1971 | Scoledge et al. | 313/113 |

*Primary Examiner*—Palmer C. Demeo

*Attorney, Agent, or Firm*—James Theodosopoulos

[57] ABSTRACT

A multihundred watt incandescent projection lamp has a continuous coiled filament in a rectangular area in front of a reflector, the filament comprising folded segments two of which extend substantially parallel from two lead wires into the envelope of the lamp. The coil end turns of the filament telescope over the lead wire ends which comprise the sole electrical supply, the sole support for the filament and also for the reflector.

4 Claims, 3 Drawing Figures

HIGH WATTAGE INCANDESCENT LAMP WITH SUPPORT FOR A PLANAR SEGMENTED FILAMENT

BACKGROUND OF THE INVENTION

This invention relates to high wattage incandescent lamps, such as lamps drawing one or several hundred watts, and particularly to a tungsten halogen projection lamp of the C13 type shown in U.S. Pat. No. 3,555,338 which is incorporated herein by reference. The lamp shown therein consists of a continuous coiled filament folded in interconnected vertical segments electrically in series. The vertical filament segments are electrically connected to each other by loops at their upper and lower ends, the loops being formed by apparatus shown in U.S. Pat. Nos. 2,759,498 and 3,163,186. As shown in U.S. Pat. No. 3,555,338, within the lamp envelope upper and lower quartz rods are fused on the two lead wires entering the glass envelope. Also fused in the two quartz rods are hooked wires which engage the upper and lower loops of eight parallel segments of coiled filament and support the eight coil segments between the two quartz rods.

Such a support for the filament segments quite satisfactorily holds the segments in a rectangular array optically centered in front of a reflector. But considerable expense is involved in the complex arrangement of quartz rods and hooked wires, and such lamps are difficult to manufacture.

Accordingly, it is the object of the present invention to provide a way of supporting the coiled filament of a high wattage lamp which simplifies the filament support structure and reduces the cost and difficulty of manufacturing the lamp.

STATEMENT OF INVENTION

According to the invention a high wattage incandescent lamp comprises a lamp envelope, two lead wires extending through the envelope and having ends terminating within the envelope, a coiled incandescent filament which coiled end turns respectively telescoping over the lead wire ends, the filament extending continuously through at least two segments on substantially parallel axes from the lead wires, and the filament segments being soley self supported on said parallel axes by the lead wires.

DRAWINGS

DESCRIPTION

Figure 1:
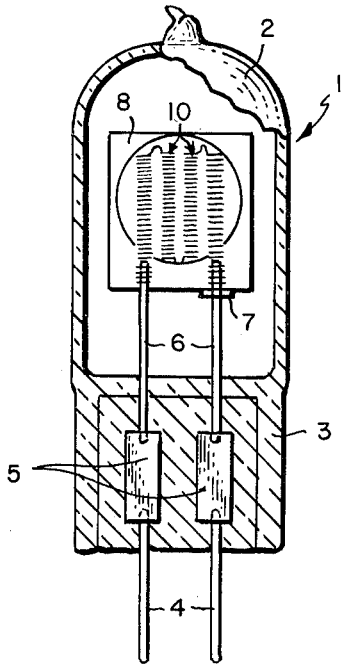
FIG. 1 is a front elevation of a high wattage tungsten-halogen projection lamp whose quartz envelope is largely broken away to show the lamp filament support.
Figure 2:
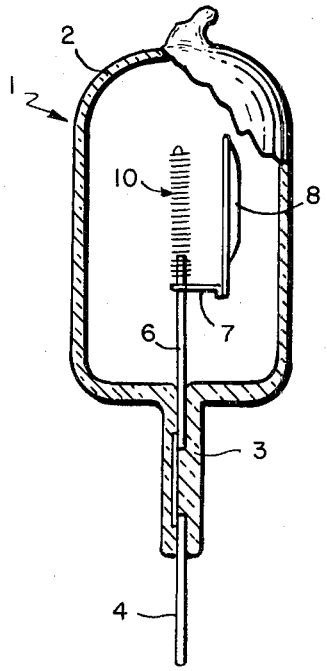
FIG. 2 is a side elevation of the lamp.
Figure 3:
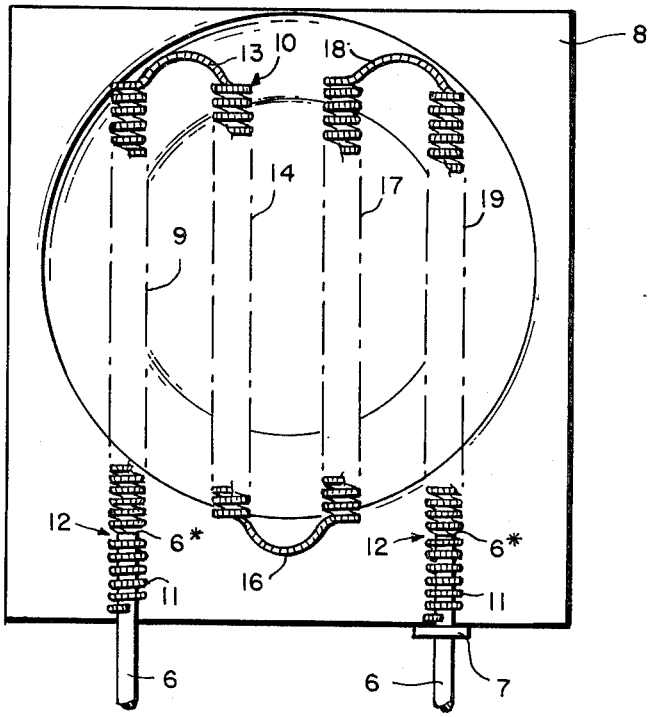
FIG. 3 is an enlarged front view of the filament and its support.

The halogen projection lamp 1 shown in FIGS. 1 to 3 comprises a quartz envelope 2 with a press 3. Two sealed leads extend through the envelope including external pins 4, internal lead wires or rods 6, also called spuds, and ribbons 5 connecting the pins 4 and internal lead wires 6.

Welded to the lead wires or spuds 6 is a wire bracket 7 supporting a reflector 8 for projecting light from a multisegment incandescent filament 10.

As shown in enlarged detail in FIG. 3, the filament 10 is formed of wire coils of refractory metal such as tungsten. The filament is folded in a rectangular, preferably square, array centered on the axis of this reflector 8. The filament 10 is continuous andd its ends 11 telescope over the ends of the spuds or lead wires 6 and are thereby adequately mechanically and electrically connected to the spuds although they may be additionally spot welded thereto if desired.

Preferably a gap 12 is preformed between turns in the coiled filament at the points of desired telescoping penetration of the spuds 6 into the two ends 11 of the filament. In manufacture, the gap 12 serves as a mark for the limit of penetration of the spud ends 6*.

Such a filament extends continuously between the spuds 6 upwardly in a segment 12 from one end 11 over the left spud 6 to a loop 13 of spreaded coil, thence downwardly through a segment 14 to a lower loop 16, upwardly in a segment 17 to an upper loop 18 and thence downwardly through a segment 19 to the other filament end 11 telescoped over the other spud 6.

A typical coiled incandescent filament for the type C13 projection lamp shown comprised four segments of coiled tungsten filament. The tungsten wire, for example, was about 13 mils diameter or 328 milligrams per 200 millimeters length. The primary mandrel on which the wire was coiled was 29 mils diameter. The wire was coiled at about 62 turns per inch and each segment had about 16 turns over a length of 7.5 mm. The four segments were spaced about 78 mils apart on their parallel center lines, and formed a rectangular about between $\frac{1}{4}$ and $\frac{3}{8}$ square inches.

Such a filament is entirely supported by the telescoping of its ends 11 over the spuds 6 to the extent indicated by the appearance of the spud ends 6* in the gaps 12 in the coil ends.

It should be understood that the present disclosure is for the purpose of illustration only and that this invention includes all modifications and equivalents which fall within the scope of the appended claims.

I claim:

1. A high wattage incandescent lamp comprising:

a lamp envelope, two lead wires extending through the envelope and having ends terminating within the envelope, a coiled incandescent filament with coiled end turns respectively telescoping over the lead wire ends, the filament extending continuously through at least two first linear segments extending on axes from the lead wires and at least two additional linear segments extending parallel to said first segments and in a common plane therewith, and the first segments being solely self supported on said axes by the lead wires, and the additional linear segments being solely supported by said first segments.

2. A lamp according to claim 1 wherein the additional segments are connected to said first segments by spread turns of coiled filament forming loops suspending the addtional segments.

3. A lamp according to claim 1 wherein each filament first segment has a substantial spacing between two of its telescoping end turns revealing the position of the lead wire ends.

4. A lamp according to claim 1 including a reflector mounted on one of the lead wires, the filament segments being self supported in a rectangular array in front of the reflector.

* * * * *